US008931387B2

(12) United States Patent
Exley et al.

(10) Patent No.: US 8,931,387 B2
(45) Date of Patent: Jan. 13, 2015

(54) LAYERING PUNCH

(75) Inventors: Ross Exley, Clifton, NJ (US); Mark Shainwald, Clifton, NJ (US); Josh Piezas, Cranford, NJ (US)

(73) Assignee: EK Success Ltd., Woodridge, IL (US)

( * ) Notice: Subject to any disclaimer, the term of this patent is extended or adjusted under 35 U.S.C. 154(b) by 607 days.

(21) Appl. No.: 13/112,704

(22) Filed: May 20, 2011
(Under 37 CFR 1.47)

(65) Prior Publication Data

US 2011/0303106 A1 Dec. 15, 2011

Related U.S. Application Data

(60) Provisional application No. 61/353,525, filed on Jun. 10, 2010.

(51) Int. Cl.

| | |
|---|---|
| ***B26F 1/02*** | (2006.01) |
| ***B26F 1/36*** | (2006.01) |
| ***B26F 1/04*** | (2006.01) |
| ***B26F 1/38*** | (2006.01) |
| *B26D 5/10* | (2006.01) |
| *B26D 7/01* | (2006.01) |

(52) U.S. Cl.
CPC ... *B26F 1/36* (2013.01); *B26F 1/04* (2013.01); *B26F 1/3846* (2013.01); *B26D 5/10* (2013.01); *B26D 7/015* (2013.01)
USPC ..... 83/684; 83/686

(58) Field of Classification Search
USPC ..... 83/684, 691, 686, 549, 468.5, 687, 220, 83/468.3, 468.6, 468.7, 39, 15, 539, 627, 83/618, 620, 556; 30/358, 360, 367, 315, 30/316, 277, 293, 379.2; 234/44, 131, 234/121, 117, 118, 112, 116
See application file for complete search history.

(56) References Cited

U.S. PATENT DOCUMENTS

| | | | |
|---|---|---|---|
| 170,460 | A | 11/1875 | Ashbourne |
| 1,228,288 | A | 5/1917 | Bower |
| 1,299,802 | A | 4/1919 | Smith |

(Continued)

FOREIGN PATENT DOCUMENTS

WO 2008046076 A2 4/2008

OTHER PUBLICATIONS

International Search Report and Written Opinion for PCT/US2011/039999, Sep. 13, 2011.

*Primary Examiner* — Ghassem Alie
(74) *Attorney, Agent, or Firm* — McDermott Will & Emery LLP

(57) ABSTRACT

A punching apparatus for a sheet media comprises a base and a handle actuator. The base comprises a first impression head that defines a first image-forming pattern and a second impression head that defines a second image-forming pattern. The base further comprises a first impression head protrusion having a first height and a second impression head protrusion having a second height. The handle actuator hingedly couples to the base. The handle actuator moves between a first position, a second position, and a third position. A limiting member contacts the first impression head protrusion when the handle actuator is moved to the second position, and the first impression head moves to a sheet media forming position. The limiting member contacts the second impression head protrusion when the handle moves to the third handle position, and the first and the second impression heads move to the sheet media forming position.

11 Claims, 5 Drawing Sheets

(56) References Cited

U.S. PATENT DOCUMENTS

| | | | | | |
|---|---|---|---|---|---|
| 1,601,414 | A | | 9/1926 | Purple | |
| 2,232,633 | A | | 2/1941 | Richardson | |
| 2,780,181 | A | | 2/1957 | Roman et al. | |
| 2,799,929 | A | | 7/1957 | Kurianski | |
| 4,166,404 | A | | 9/1979 | Almog | |
| 4,180,889 | A | | 1/1980 | Joffe | |
| D256,479 | S | | 8/1980 | Manusch | |
| 4,240,572 | A | | 12/1980 | Mitsuhashi | |
| 4,362,497 | A | | 12/1982 | Lifshitz | |
| 4,484,390 | A | | 11/1984 | Wojtowicz | |
| 4,516,923 | A | | 5/1985 | Lifshitz et al. | |
| 4,530,275 | A | | 7/1985 | Stickle et al. | |
| 4,623,089 | A | * | 11/1986 | Scott | 234/114 |
| D303,812 | S | | 10/1989 | Sun | |
| D309,916 | S | | 8/1990 | Higashi | |
| 5,005,458 | A | | 4/1991 | Merrick | |
| 5,012,712 | A | * | 5/1991 | Nordquist | 83/571 |
| 5,067,242 | A | | 11/1991 | Singer | |
| 5,149,594 | A | | 9/1992 | Lewandowski et al. | |
| D330,149 | S | | 10/1992 | Weimer | |
| 5,251,524 | A | | 10/1993 | Clifford | |
| 5,259,750 | A | | 11/1993 | Lewandowski et al. | |
| 5,303,473 | A | | 4/1994 | Sadler | |
| D373,385 | S | | 9/1996 | Birkholz | |
| 5,601,006 | A | * | 2/1997 | Quinn et al. | 83/588 |
| 5,660,105 | A | | 8/1997 | Benson et al. | |
| D406,606 | S | | 3/1999 | Lee | |
| D408,453 | S | | 4/1999 | Mori | |
| D415,529 | S | | 10/1999 | Mori | |
| 6,089,137 | A | * | 7/2000 | Lee | 83/621 |
| 6,194,017 | B1 | | 2/2001 | Woodward et al. | |
| 6,209,434 | B1 | * | 4/2001 | Kim et al. | 83/549 |
| 6,386,854 | B1 | | 5/2002 | Guss | |
| 6,428,248 | B1 | | 8/2002 | Lee | |
| 6,513,413 | B2 | | 2/2003 | Lee | |
| 6,516,523 | B1 | | 2/2003 | Lin | |
| D477,028 | S | | 7/2003 | Huang | |
| RE38,219 | E | | 8/2003 | Lee et al. | |
| 6,718,641 | B2 | | 4/2004 | Hsuan | |
| 6,736,045 | B2 | | 5/2004 | Chang | |
| 6,739,244 | B1 | | 5/2004 | Carbaugh | |
| 6,742,431 | B1 | | 6/2004 | Oh | |
| 6,752,058 | B2 | | 6/2004 | Oh | |
| 6,874,189 | B2 | | 4/2005 | Ackeret | |
| 6,895,842 | B2 | | 5/2005 | Magnusson | |
| 6,938,542 | B1 | | 9/2005 | Ho et al. | |
| 7,011,009 | B1 | | 3/2006 | Tomich | |
| D530,991 | S | | 10/2006 | West et al. | |
| 7,284,478 | B2 | | 10/2007 | Lee | |
| 7,316,555 | B2 | | 1/2008 | Hubener | |
| 7,343,854 | B2 | | 3/2008 | Nadal-Linares et al. | |
| 7,882,641 | B2 | | 2/2011 | Repac | |
| 2004/0007107 | A1 | | 1/2004 | Bost et al. | |
| 2004/0099113 | A1 | | 5/2004 | Hixon et al. | |
| 2004/0103772 | A1 | | 6/2004 | Normington | |
| 2006/0228955 | A1 | | 10/2006 | Rivera | |
| 2007/0051221 | A1 | | 3/2007 | Corcoran et al. | |
| 2007/0056422 | A1 | | 3/2007 | Lee | |
| 2007/0144359 | A1 | | 6/2007 | Ekberg et al. | |
| 2007/0180969 | A1 | | 8/2007 | Kanasashi et al. | |
| 2007/0266836 | A1 | | 11/2007 | Marks | |
| 2008/0156160 | A1 | | 7/2008 | Yamashita et al. | |
| 2010/0294102 | A1 | * | 11/2010 | Henkemeyer et al. | 83/691 |
| 2011/0107889 | A1 | * | 5/2011 | Lee | 83/168 |

* cited by examiner

LAYERING PUNCH

CROSS-REFERENCE TO RELATED APPLICATIONS

This application claims priority to U.S. Provisional Patent Application Ser. No. 61/353,525 filed Jun. 10, 2010.

TECHNICAL FIELD

The invention relates to a punching apparatus for sheet media, such as a sheet of paper, and more particularly to a punching apparatus for sheet media with a plurality of selectable impression heads that each generate an image-forming pattern.

BACKGROUND OF THE INVENTION

When working on decorative projects, such as for crafts, scrapbooking, invitations, or the like, a punch may be utilized to form a pattern on sheet media, such as, for example, paper, paperboard, and cardboard, by removing material from the sheet media so that either the material removed from the sheet media may be used for a decorative element, or the remaining sheet media with material removed may be used for a decorative element. Sometimes it is desired to create multiple different patterns or shapes on the sheet media, without having to obtain a separate punch. Thus, a need exists for a layering punch that allows a user to select from a plurality of patterns when forming a pattern on sheet media with a punch.

The present invention is provided to solve the problems discussed above and other problems, and to provide advantages and aspects not provided by prior punches. A full discussion of the features and advantages of the present invention is deferred to the following detailed description, which proceeds with reference to the accompanying drawings.

SUMMARY OF THE INVENTION

According to one embodiment, a punching apparatus for a sheet media comprises a base, a handle actuator, and a selector. The base comprises a sheet media receiving surface, a primary impression head, a secondary impression head, and a plurality of impression head protrusions. The primary impression head has a first image-forming pattern. The secondary impression head has a second image-forming pattern. The plurality of impression head protrusions extend upwardly from the base. Each of the plurality of impression head protrusions are spaced at a predetermined distance from the other of the plurality of impression head protrusions. Each of the plurality of impression head protrusions has a height different from the height of the other of the plurality of impression head protrusions. The handle actuator couples to the base. The handle actuator is moveable between an inactive position and a punching position. The selector selectively activates at least one of either the primary impression head and the secondary impression head. The selector is moveable between a plurality of distinct positions. Each of the plurality of distinct positions corresponds to a position adjacent one of the plurality of impression head protrusions. A portion of the selector is configured to engage at least one of the plurality of impression head protrusions when the handle actuator is moved to the punching position.

According to another embodiment, a punching apparatus for a sheet media comprises a base, an impression head holding body, and a handle actuator. The base comprises a sheet media receiving surface, a first impression head protrusion and a second impression head protrusion. The sheet media receiving surface has an opening formed therein. The first impression head protrusion and the second impression head protrusion extend upwardly from the base. Each of the first and second impression head protrusions are spaced at a predetermined distance from the other of the of first and second impression head protrusions. The first impression head protrusions has a height different from the height of second impression head protrusion. The impression head holding body has a first end and a second end and comprises a primary impression head that has a first image-forming pattern defined therein and a secondary impression head that has a second image-forming pattern defined therein. The impression head holding body is disposed generally above the base. The primary impression head and the secondary impression head are generally aligned with the opening of the sheet media receiving surface of the base. The primary impression head and the secondary impression head are moveable relative to the impression head holding body between a first vertical position, a second vertical position, and a third vertical position. The handle actuator pivotally mounts to the first end of the impression head holding body. The handle actuator is movable between an inactive position and a punching position. The handle actuator includes a limiting member movable between a first position and a second position, wherein when the limiting member is moved to the first position, the limiting member is aligned with the first impression protrusion of the base, and wherein when the limiting member is in the second position, the limiting member is aligned with the second impression protrusion of the base. The primary impression head and the secondary impression head move to the second vertical position when the travel limiting member engages the first impression protrusion, and wherein the primary impression head and the secondary impression head move to the third vertical position when the travel limiting member engages the second impression protrusion.

According to a further embodiment, a punching apparatus for a sheet media comprises a base and a handle actuator. The base comprises a first impression head that defines a first image-forming pattern and a second impression head that defines a second image-forming pattern. The base further comprises a first impression head protrusion having a first height and a second impression head protrusion having a second height. The handle actuator is hingedly coupled to the base. The handle actuator is movable between a first position, a second position, and a third position. When the handle actuator is moved to the second position, a limiting member contacts the first impression head protrusion, and when the handle actuator is moved to the second position, the first impression head moves to a sheet media forming position wherein the first pattern is formable in the sheet media. When the handle actuator is moved to the third position, the limiting member contacts the second impression head protrusion in the third handle position and the first and the second impression heads are moved to the sheet media forming position wherein a second pattern is formable in the sheet media.

According to yet another embodiment, a punching apparatus for a sheet media comprises a base and a handle actuator. The base comprises a sheet media receiving surface, a primary impression head, and a secondary impression head. The primary impression head has a first image-forming pattern. The secondary impression head has a second image-forming pattern. The secondary impression head is concentrically disposed about a periphery of the primary impression head. The handle actuator couples to the base. The handle actuator is moveable between at least an inactive position, a first punching position, and a second punching position. When the handle actuator is moved to the first punching position, the primary impression head passes through a plane formed by the sheet media receiving surface. When the handle actuator is moved to the second punching position, at least the secondary impression head passes through the plane formed by sheet media receiving surface.

Other features and advantages will be apparent from the following specification taken in conjunction with the following drawings.

BRIEF DESCRIPTION OF THE DRAWINGS

To understand the present invention, it will now be described by way of example, with reference to the accompanying drawings in which.

Figure 1:
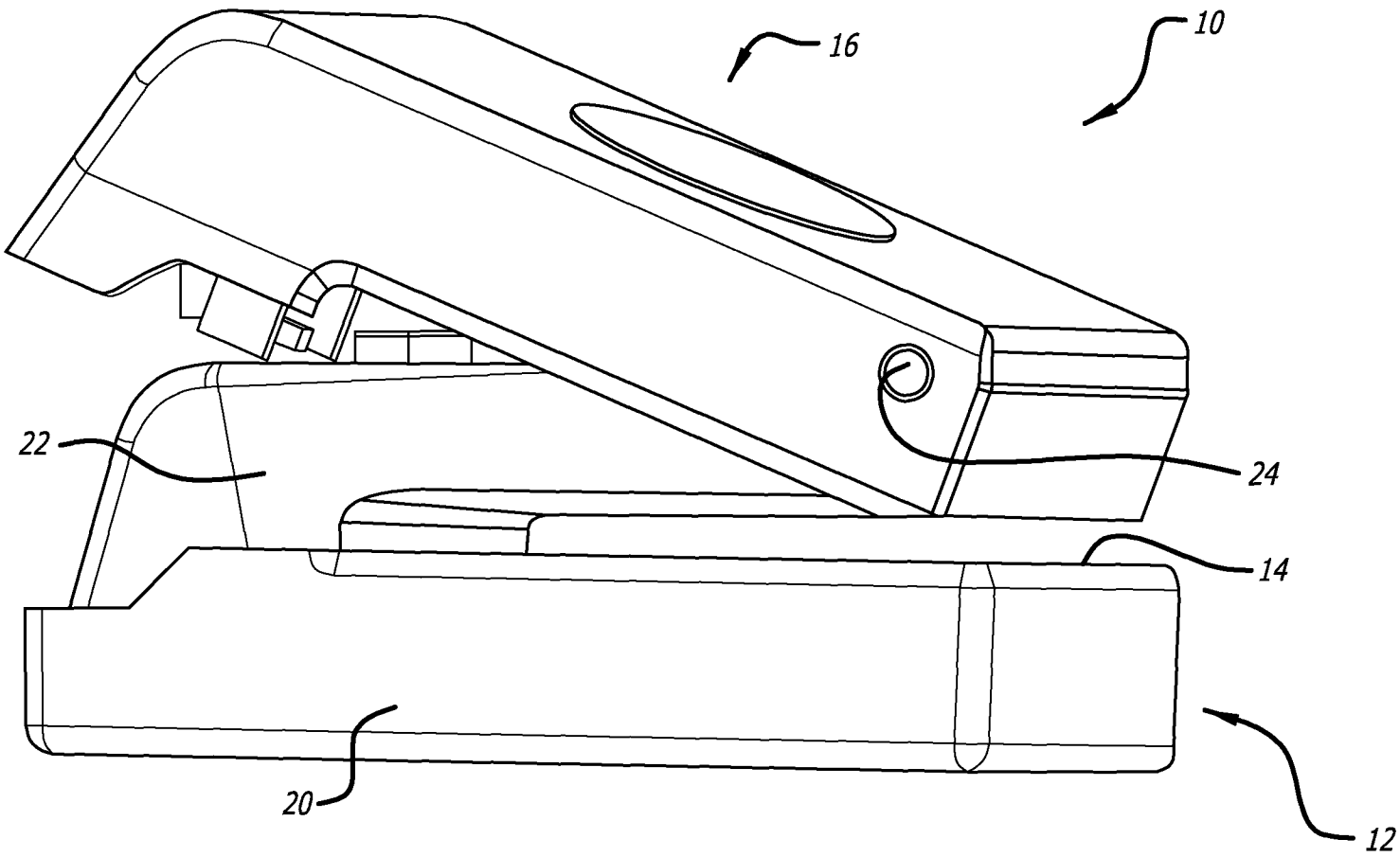
FIG. 1 is a perspective view of a layering punch according to one embodiment in an open position.

The components in the drawings are not necessarily to scale, emphasis instead being placed upon clearly illustrating the principles of the present invention.

DETAILED DESCRIPTION

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
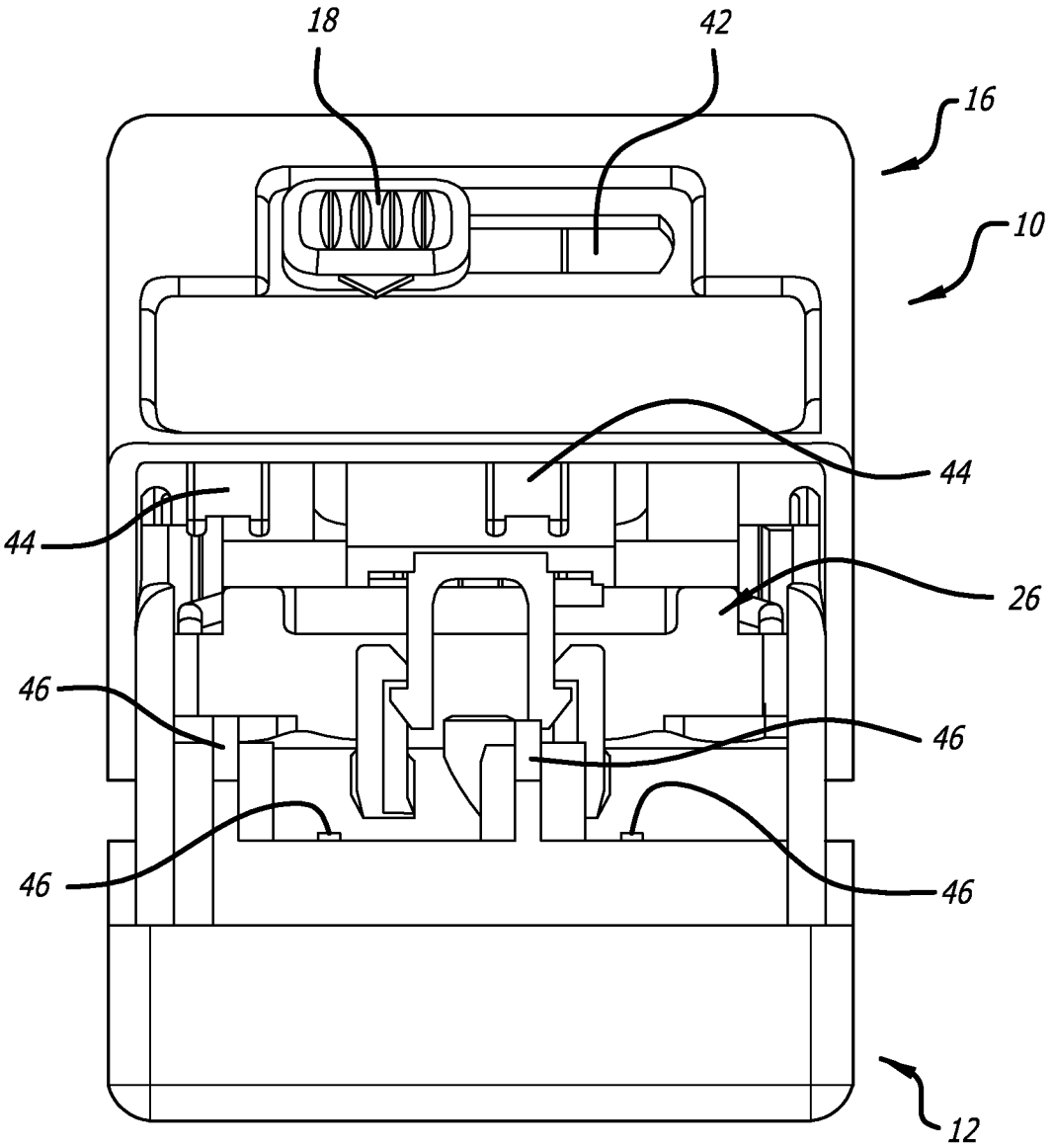
FIG. 2 is a end view of the layering punch of FIG. 1.
Figure 3:
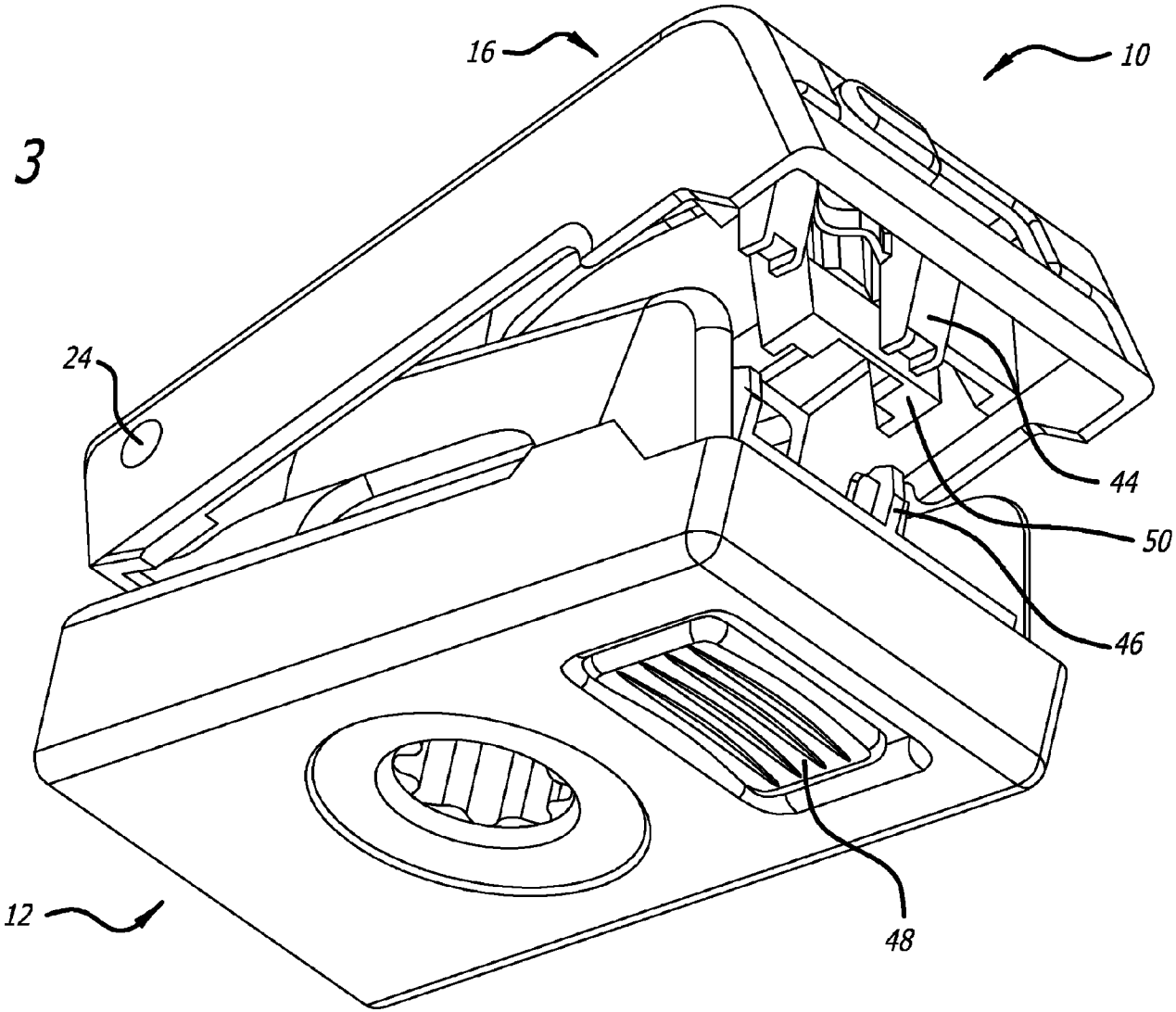
FIG. 3 is a bottom perspective view of the layering punch of FIG. 1.

FIGS. 1-4 show a layering punch 10 according to one embodiment. The layering punch 10 comprises a base 12 having a sheet media receiving surface 14, a handle actuator 16, and a selector 18 (FIG. 2). The base 12 has a lower base portion 20 and an upper base portion 22. As shown in FIGS. 1-3 the lower base portion 20 and the upper base portion 22 of the base 12 are separate components, but it is contemplated that the base 12 may be a unitary component. It is contemplated that the media receiving surface 14 will contain an opening, so that the sheet media may be punched.

Figure 4:
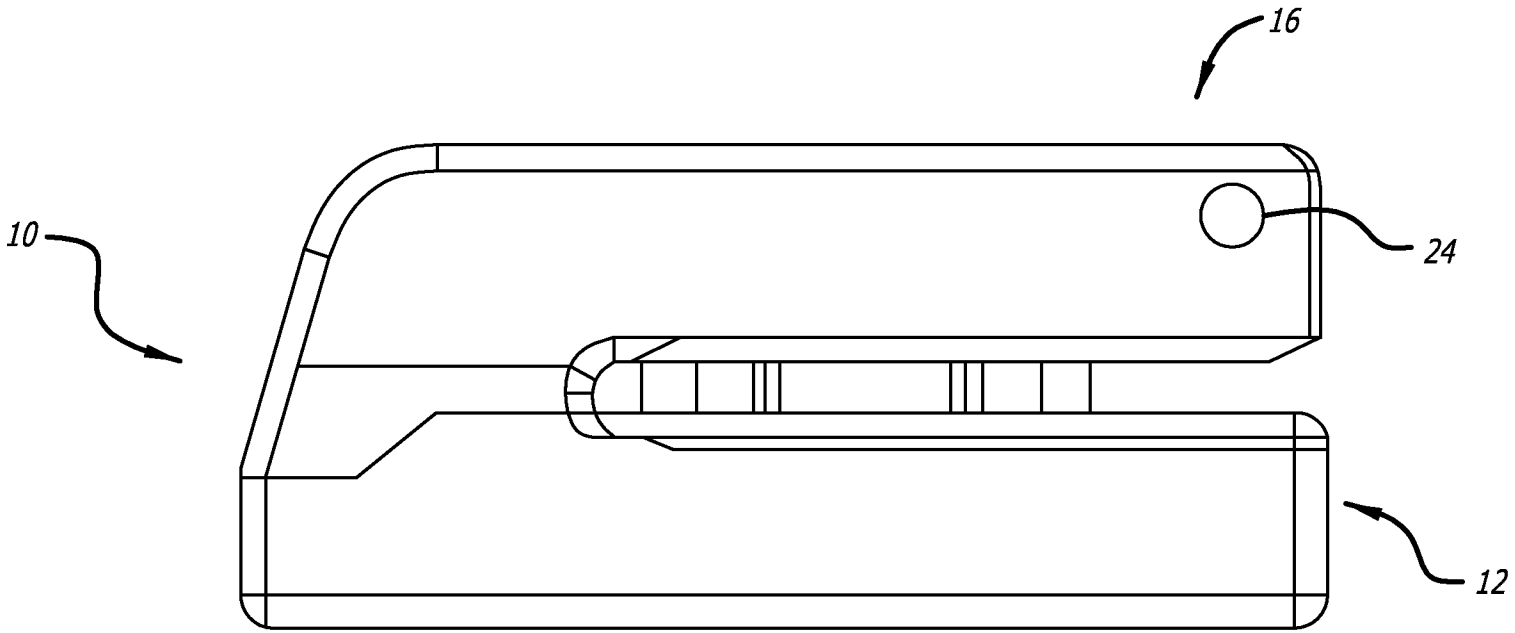
FIG. 4 is a side view of the layering punch of FIG. 1 in a closed position.

The handle actuator 16 is pivotally connected to the base 12. A pivot pin 24 is utilized to secure the handle actuator 16 to the base 12 and also forms a pivot axis about which the handle actuator 16 rotates. FIGS. 1-3 show the handle actuator 16 in an open position, while FIG. 4 shows the handle actuator 16 in a closed position. As the handle actuator 16 pivots about the pivot pin 24, pressure is applied to an impression head assembly 26.

Figure 5:
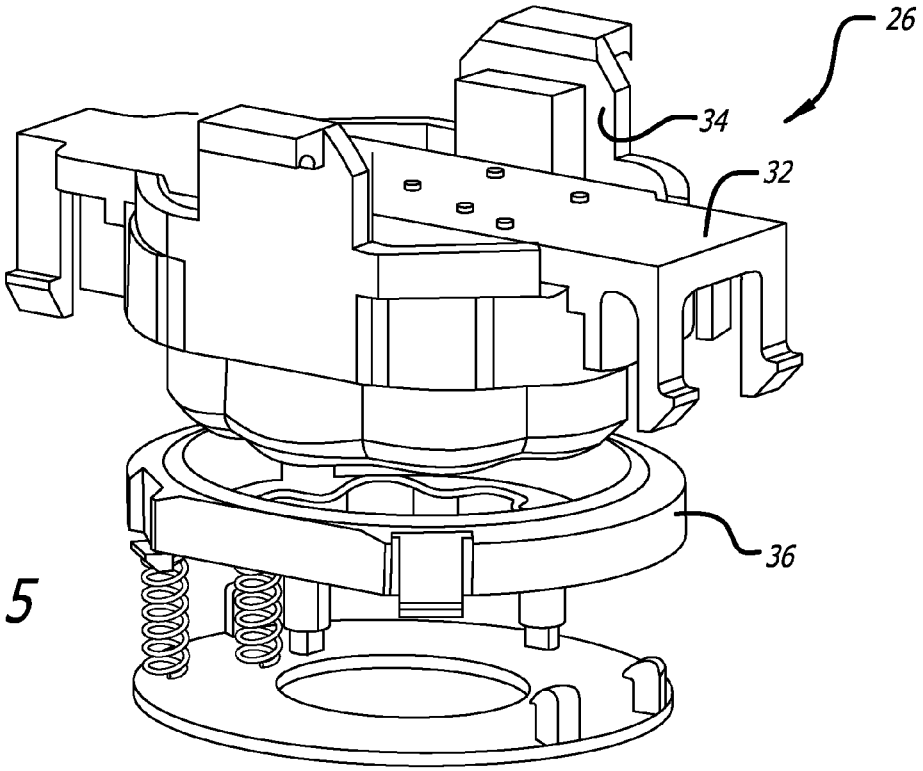
FIG. 5 is a perspective view of an impression head portion of the layering punch of FIG. 1.
Figure 6:
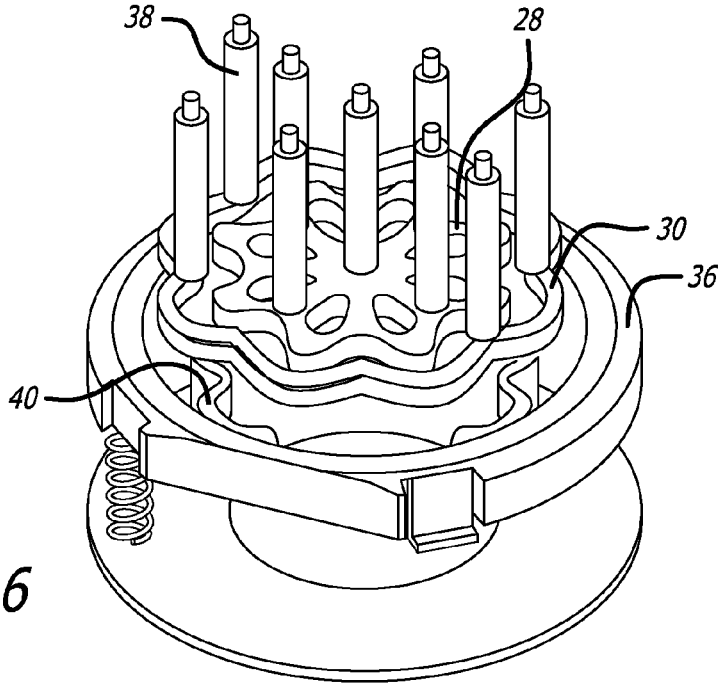
FIG. 6 is a perspective view a first and second impression head of the layering punch of FIG. 1.

As shown in FIGS. 5 and 6, The impression head assembly 26 comprises at least a first impression head 28 and a second impression head 30. The first impression head 28 has a first image-forming pattern, while the second impression head 30 has as a second image-forming pattern. As shown in FIG. 6, the first impression head 28 is disposed within a perimeter of the second impression head 30. As such, the use of the first impression head 28 and the second impression head 30 simultaneously may act as a third impression head.

FIG. 5 shows the impression head activating plate 32 as well as the impression head carrier 34. The impression head activating plate 32 is contacted by the handle actuator 16 to cause movement of the impression head carrier 34. The first impression head 28 and the second impression head 30 are secured between the impression head carrier 34 and the impression head activating plate by a plurality of pins 38. The pins 38 distribute pressure from the impression head activating plate 32 over the surfaces of the first and second impression heads 28, 30 so that forces are generally uniform over the surfaces of the first and second impression heads 28, 30. The application of uniform pressure to the first and second impression heads 28, 30 helps to ensure that the image provided to the sheet media is aesthetically pleasing. The impression head carrier 34 may have a third impression head disposed therein. The third impression head may be aligned with the plurality of generally tear-drop shaped openings formed in the first impression head 28. The third impression head may thus be utilized in the formation of a third pattern in the sheet media.

An impression head guide 36 is also provided. The impression head guide 36 has an impression head engaging portion 40. The impression head engaging portion 40 has a complimentary shape to the first impression head 28 and the second impression head 30. The impression head engaging portion 40 is positioned such that the first impression head 28 is disposed interiorly of the impression head engaging portion 40, while the second impression head 30 is disposed exteriorly of the impression head engaging portion 40. The impression head engaging portion 40 helps to guide the first and second impression head 28, 30 during use.

Turning back to FIG. 2, the selector 18 is depicted. The selector allows for the activation of at least one of the first impression head 28 and the second impression head 30. The selector 18 moves about a channel 42 formed in the handle actuator 16. The selector 18 is shown having a pair of stop members 44 that are connected to the selector 18 and move with the selector along the channel 42. The stop members 44 are adapted to engage a plurality of impression head protrusions 46. A total of four impression head protrusions 46 are shown. The impression head protrusions 46 are provided on the base 12. Two of the impression head protrusions 46 are shown having a first height, and two of the impression head protrusions 46 are shown as having a second height.

The selector 18 is adapted to move between a first position, as shown in FIG. 2, where the stop members 44 align with the impression head protrusions 46 having the first height, a second position where the stop members 44 align with the impression head protrusions 46 have a second height, and a third position where no impression head protrusions 46 are provided. As the handle actuator 16 moves from an open position, as shown in FIG. 1 to a closed position, as shown in FIG. 4, the stop members 44 contact the impression head protrusions 46 when the selector 18 is aligned in two of the three positions. The contact of the stop member 44 with the impression head protrusion 46 limits further movement of the handle actuator 16. The amount of movement of the handle actuator determines which of the first impression head 28 and the second impression head 30 contact the sheet media. For instance, when the selector 18 aligns the stop member 44 with the impression head protrusions 46 having the greatest height, only the second impression head 30 contacts the sheet media. If the selector 18 aligns the stop member 44 with the impression head protrusions 46 having the shortest height, both the first impression head 28 and the second impression head 30 contact the sheet media. Finally, if the selector 18 aligns the stop member 44 with none of the impression head protrusions 46, the first impression head 28, the second impression head 30 and the third impression head within the impression head carrier 34 contact the sheet media. Thus, depending on the position of the selector 18, three distinct designs may be created on the sheet media by the punch apparatus 10 shown in the embodiments. It is contemplated that a design may be provided on the handle actuator 16 adjacent the selector 18 to provide a visual representation of the pattern that the punch apparatus 10 will form in the sheet media.

It is also contemplated that according to another embodiment, the selector 18 may cause only the first impression head 28 to contact the sheet media in a first selector position, only the second impression head 30 contacts the sheet media in a second selector position, and both the first and second impression heads 28, 30 contact the sheet media in a third selector position.

FIG. 3 shows a locking mechanism 48 provided on the punch apparatus 10. The locking mechanism 48 is moveable between a locked position and an unlocked position. FIG. 3 shows the locking mechanism 48 in the unlocked position. The locking mechanism 48 is adapted to hold the handle actuator 16 in a closed position when the locking mechanism 48 is in the locked position. The locking mechanism interacts with a ledge 50 disposed on the handle actuator 16, such that a portion of the locking mechanism 48 contacts the ledge 50 of the handle actuator.

It is contemplated that the first impression head 28 and the second impression head 30 may be a variety of types of impression heads, such as cutting heads, embossing heads, and the like.

While the specific embodiments have been illustrated and described, numerous modifications come to mind without significantly departing from the spirit of the invention, and the scope of protection is only limited by the scope of the accompanying Claims.

What is claimed is:

1. A punching apparatus for a sheet media comprising:
a base comprising:
a sheet media receiving surface;
a primary impression head having a first image-forming pattern;
a secondary impression head having a second image-forming pattern, wherein the secondary impression head is concentrically disposed about the entire periphery of the primary impression head; a handle actuator
coupled to the base, the handle actuator being moveable between at least an inactive position, a first punching position, and a second punching position, wherein when the handle actuator is moved to the first punching position the primary impression head passes through a plane formed by the sheet media receiving surface, and wherein when the handle actuator is moved to the second punching position, at least the secondary impression head passes through the plane formed by the sheet media receiving surface; and a selector being movable between a plurality of distinct positions perpendicular to a moving direction of the primary impression head and the secondary impression head.

2. The punching apparatus for a sheet media of claim 1, the base further comprising a plurality of impression head protrusions extending upwardly from the base, each of the plurality of impression head protrusions being spaced at a predetermined distance from the other of the plurality of impression head protrusions, and each of the plurality of impression head protrusions having a height different from the height of the other of the plurality of impression head protrusions.

3. The punching apparatus for a sheet media of claim 2, further comprising the selector provided for selectively activating at least one of either the primary impression head and the secondary impression head, the selector being moveable between a plurality of distinct positions, each of the plurality of distinct positions corresponding to a position adjacent one of the plurality of impression head protrusions, a portion of the selector being configured to engage one of the plurality of impression head protrusions when the handle actuator is moved to the punching position.

4. A punching apparatus for a sheet media comprising:
a base comprising:
a sheet media receiving surface;
a primary impression head having a first image-forming pattern;
a secondary impression head having a second image-forming pattern wherein the primary impression head is disposed within the entire perimeter of the secondary impression head; and
a plurality of impression head protrusions extending upwardly from the base, each of the plurality of impression head protrusions being spaced at a predetermined distance from the other of the plurality of impression head protrusions, and each of the plurality of impression head protrusions having a height different from the height of the other of the plurality of impression head protrusions;
a handle actuator coupled to the base, the handle actuator being moveable between an inactive position and a punching position, wherein when the handle actuator is moved to the punching position; and
a selector provided for selectively activating at least one of either the primary impression head and the secondary impression head, the selector being moveable between a plurality of distinct positions perpendicular to a moving direction of the primary impression head the secondary impression head, each of the plurality of distinct positions corresponding to a position adjacent one of the plurality of impression head protrusions, a portion of the selector being configured to engage at least one of the plurality of impression head protrusions when the handle actuator is moved to the punching position.

5. The punching apparatus of claim 4, wherein the selector is moveable between a first position and a second position, the first position indicating selection of only the primary impression head, the second position indicating selection of both the primary and the secondary impression heads.

6. The punching apparatus of claim 5, wherein movement of the selector between a first of the plurality of positions and the second of the plurality of positions causes movement of a limiting member attached to the selector from alignment with a primary impression head protrusion into alignment with the secondary impression head protrusion, and wherein alignment of the limiting member with the primary impression head protrusion allows engagement between a sheet media and the primary impression head, and wherein alignment of the limiting member with the secondary impression head protrusion allows engagement between a sheet media and both the first and second impression heads.

7. The punching apparatus of claim 4, wherein the selector is moveable between a first position, a second position, and a third position, the first position causing activation of only the primary impression head, the second position causing activation of the primary head and the secondary head, and the third position moving the punching apparatus to a locking position.

8. The punching apparatus of claim 7, further comprising a locking mechanism provided to maintain the apparatus in the locking position.

9. The punching apparatus of claim 4, wherein at least one of the first and second impression heads comprises a cutting head.

10. The punching apparatus of claim 4, wherein at least one of the first and second impression heads comprises an embossing head.

11. The punching apparatus of claim 4, wherein the selector is configured to provide a visual indication of the selected one of the primary and secondary impression heads.

* * * * *